US005100340A

United States Patent [19]

Lostumo et al.

[11] Patent Number: 5,100,340

[45] Date of Patent: Mar. 31, 1992

[54] CATHODE RAY TUBE ELECTRICAL JUNCTION BOX

[75] Inventors: Arthur J. Lostumo, Franklin Park; Steven J. Pulchinski, Rolling Meadows, both of Ill.

[73] Assignee: Zenith Electronics Corporation, Glenview, Ill.

[21] Appl. No.: 727,724

[22] Filed: Jul. 10, 1991

[51] Int. Cl.[5] ..... H01R 4/24

[52] U.S. Cl. ..... 439/441

[58] Field of Search ..... 439/436–441

[56] References Cited

U.S. PATENT DOCUMENTS

| | | | |
|---|---|---|---|
| 3,093,433 | 6/1963 | Ege | 439/441 |
| 3,569,911 | 3/1971 | Bogdanowicz | 439/441 |
| 4,566,748 | 1/1986 | Tanishi et al. | 439/441 |

*Primary Examiner*—Joseph H. McGlynn

[57] ABSTRACT

A junction box provides for interconnecting a plurality of sheathed, bare-end, high-voltage conductors for cathode ray tubes and the like. The junction box includes an enclosure, a plurality of spaced, parallel-arranged leaf-spring terminals mounted within the enclosure, and a like plurality of guides for guiding conductors into the enclosure and into contact with respective terminals. Ganged cams mounted on a slider provide for simultaneously locking a plurality of conductors in the enclosure against withdrawal by counter-deflecting the terminals against the conductors and prevent withdrawal from the enclosure. In addition to the quick connection of high-voltage conductors, the junction box provides for controlling the static and dynamic focusing of an electron gun.

5 Claims, 4 Drawing Sheets

CATHODE RAY TUBE ELECTRICAL JUNCTION BOX

BACKGROUND OF THE INVENTION

1. Field of the Invention

This invention relates to color cathode ray picture tubes and is addressed particularly to means for making electrical connection to the electron gun used in such tubes.

Electron guns in common use for color cathode ray tubes provide three electron beams that lie side-by-side in the same plane. The electrodes that form each of the beams are "unitized"; that is, they are mechanically and electrically connected and are at the same electrical potential. The apertures of the electrodes are coaxially arranged for passage of the beams.

A typical electron gun for a color tube has these basic elements: three discrete cathodes for generating the three separate beams, a unitized control electrode that acts in conjunction with the cathode for controlling the intensity of the beam, a unitized first accelerating electrode, a unitized focusing electrode for focusing the beams, and a final, unitized high-voltage second accelerating anode also called the anode electrode.

The potential on the focusing electrode is normally varied manually for focusing the three beams at the center of the screen. Also, the voltage may be varied dynamically to maintain the beams in focus at all points on the screen. A dynamic focusing voltage is necessary as the "throw" distance of the beams vary as they scan from the center of the screen to the sides of the screen. Electrodes such as a focusing electrode may be composed of two or more parts, each having a different electrical potential.

2. Prior Art

An electrical connector manufactured by Hosiden of Tokyo, Japan, provides for connection to the multiple-pin socket of a cathode ray tube. The connector has means for releasably connecting a high-voltage conductor to the socket. The means comprises a wall internal to the socket which is in contact with an opposed, downwardly inclined spring member. The connection of the high-voltage conductor to the socket is accomplished by pushing the bared end of the conductor between the wall and the spring member. At this stage, the conductor can be readily released from the socket. The connection is made non-releasable by a segment which is forced against the spring member to prevent its retraction from the bared end of the wire. The segment is pivoted on a "living hinge" so it can be withdrawn for release of the conductor. The conductor is connected to an anode of the electron gun that requires a high voltage potential for operation. The socket also houses an arc-suppression spark gap.

OBJECTS OF THE INVENTION

It is a general object of the invention to provide junction means for the interconnection of a plurality of high-voltage conductors for cathode ray tubes and the like, or connecting one or more conductors to ground or to another potential.

It is an object of the invention to provide a housing having releasable wire-retention means for receiving and captivating a plurality of high-voltage electrical conductors.

It is another object of the invention to provide means for simultaneously locking in or releasing a plurality of conductors from the enclosure.

It is a further object of the invention to provide a housing for voltage control components for the electron gun of cathode ray tubes.

It is yet another object to provide an insulative housing for a voltage-control components operating at a high voltage.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

Figure 1:
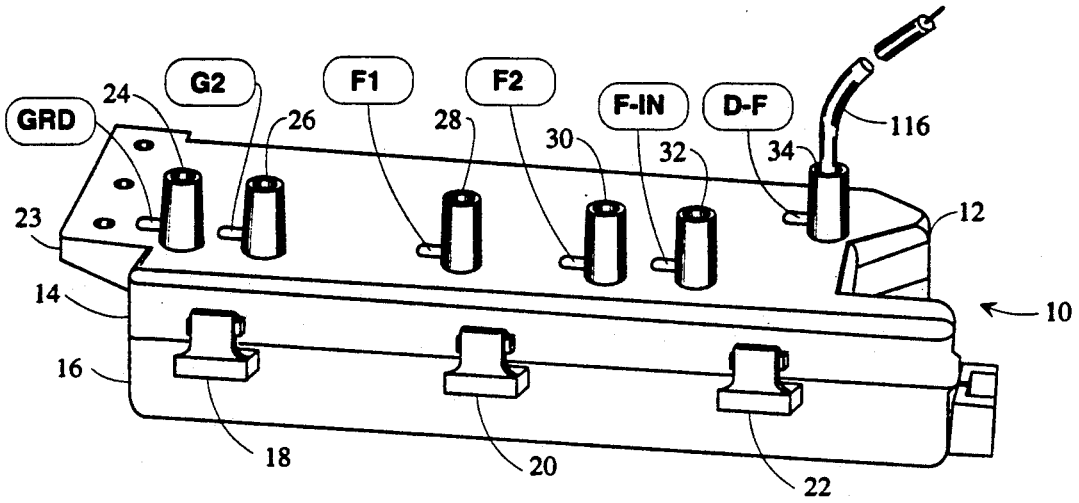
FIG. 1 is a oblique view in perspective of a junction box according to the invention.

FIG. 1 is a depiction of a junction box 10 according to the invention. Junction box 10 provides for interconnecting a plurality of high-voltage conductors for cathode ray tubes, and the like. It also houses voltage-control components for an electron gun.

Junction box 10 comprises housing means including enclosure means 12 for enclosing the components of the junction box 10. Enclosure 12 is indicated as consisting of two separable parts: a cover section 14 and a base section 16 which are releasably fastened together by latches 18, 20 and 22. Three similar latches (not shown in this view) are located on the back side of the enclosure 12.

The junction box 10 can be mounted on the chassis of a television set or monitor by means of bracket 23 that extends from cover section 14. The unit can be mounted on any convenient location on the chassis permitting access for the connectors and the control elements of the junction box.

A plurality of spaced, parallel-arranged, leaf-spring terminals are mounted within enclosure 12, as will be described. A like plurality of conductor guide means 24, 26, 28, 30, 32 and 34, shown as being six in number by way of example, provide for guiding electrical conductors into enclosure 12 and into contact with respective leaf-spring terminals within enclosure 12. The letters circled, e.g. F-IN et al, are those embossed on cover section 14 adjacent to each of the conductor guide means 24–34.

Figure 2:
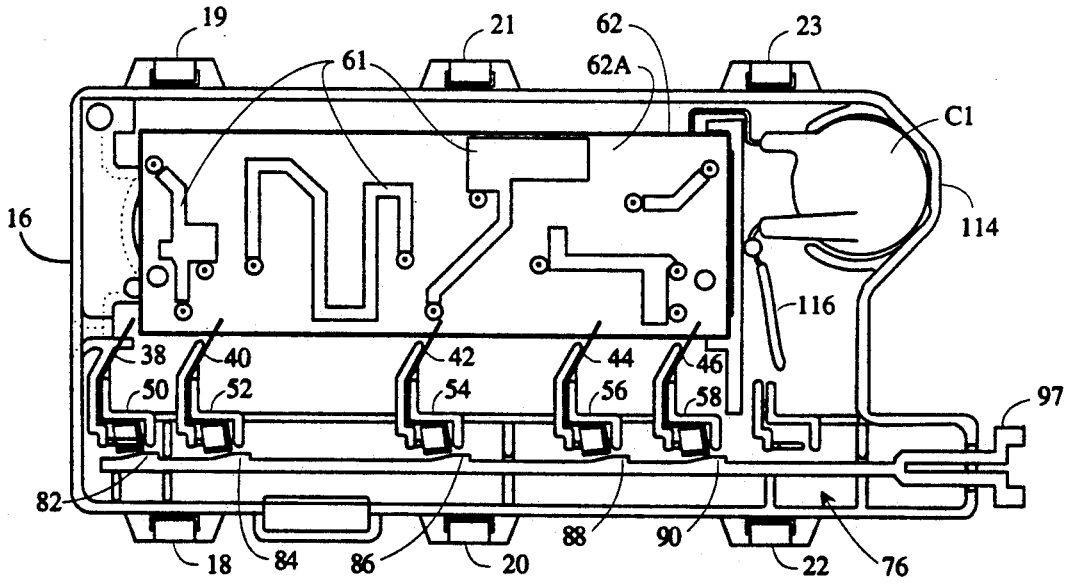
FIG. 2 is a plan view of an interior section of the junction box of FIG. 1.

In FIG. 2, cover section 14 has been removed to provide a plan view of the interior of base section 16. A plurality of spaced, parallel-arranged leaf-spring terminals 38, 40, 42, 44, and 46 are mounted within housing 12. A like plurality of back support means 50, 52, 54, 56 and 58, respectively, are located adjacent to respective ones of terminals 38–46 and conductor guide means 24–34. An end of each of the leaf-spring terminals 38–46 is shown as electrically connected to respective ones of the segments of the conductive patterns 61 on side 62A of a printed circuit board 62. Latches 19, 21, and 23, which are opposite to latches 18, 20 and 21 shown by FIG. 1, are also depicted.

Figure 3:
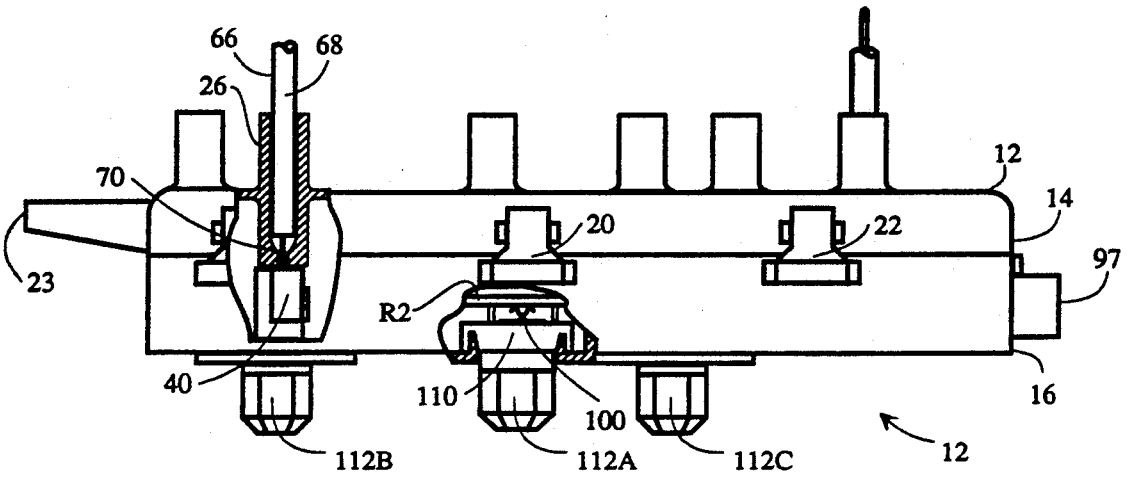
FIG. 3 is a side view in elevation and partially cut away of the junction box according to the invention.

FIG. 3 depicts the insertion of a high-voltage conductor 66, shown as having an insulative sheath 68, into guide means 26, with the bare end 70 of high-voltage conductor 66 being gripped by leaf-spring terminal 40. The bare end 70 is about three-eighths of an inch long. Insertion of a high-voltage conductor into guide means 24 and guide means 28–34 is indentical.

Figure 4:
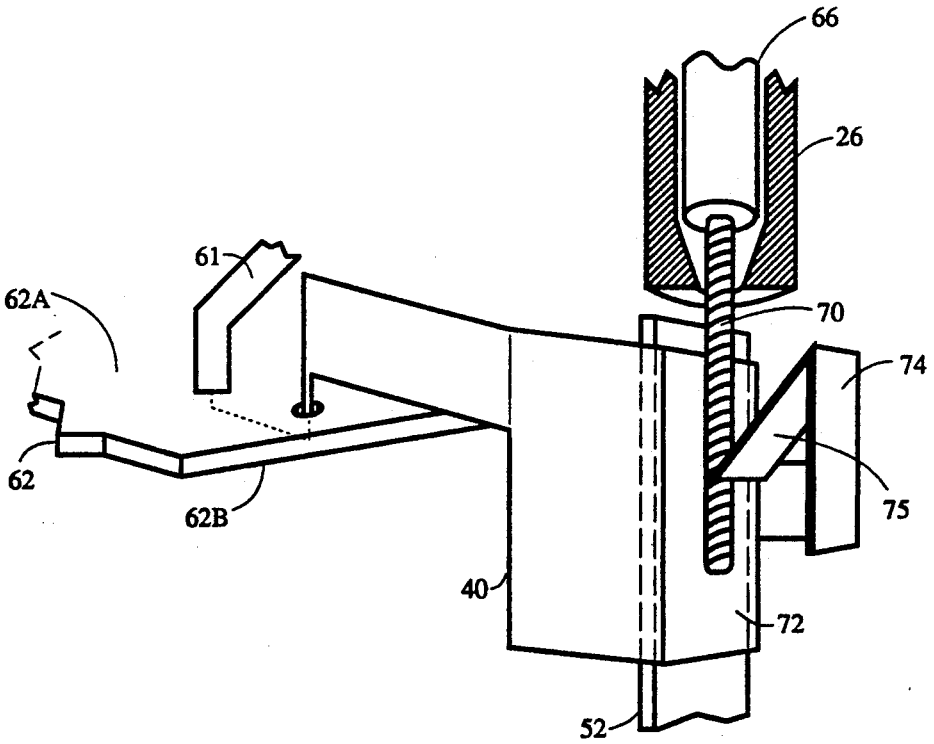
FIG. 4 is a detail view in perspective depicting means for gripping the bare end of a high-voltage conductor inserted into the junction box.

FIG. 4 shows details of the means for gripping of the bare end 70 of high-voltage conductor 66 by leaf-spring terminal 40, an action typical of all leaf-spring terminals 38 and 42–46. Back support means 52 is shown as supporting one side of the bare end 70 of conductor 66 by its support of a panel 72 of terminal 40. The back support means 52 and terminal 40 are constructed and arranged such that as conductor 66 is inserted into enclosure 12 and guided to terminal 40 by guide means 26, the terminal 40 is deflected and the bare end 70 of conductor 66 is friction-gripped by terminal 40 such as to modestly resist inadvertent withdrawal of the conductor from the terminal 40 and enclosure 12. The mechanism for friction-gripping the bare end 70 of conductor 66 is shown as being an inverted, V-shaped leaf spring, one leg 74 of which is anchored, and a free leg 75 which deflects to engage and frictionally grip bare end 70 of conductor 66.

With reference to FIG. 5 and again to FIG. 2, the ganged cam means 76 provide for simultaneously locking in, or releasing, a plurality of high-voltage conductors inserted into enclosure 12 against withdrawal. Ganged cam means comprises a slider 78 mounted for manual reciprocal movement behind the plurality of terminals 38–46 and orthogonal to the direction of insertion of the conductors into enclosure 12. Slider 78 mounts a like plurality of cam means 82, 84, 86, 88, and 90 which act, when slider 78 is reciprocated into a locking position, to counter-deflect terminals 38–46 against the bare ends of the conductors, thereby greatly amplifying the friction forces applied to the bare ends of the conductors, thereby preventing withdrawal thereof from the enclosure.

Figure 5:
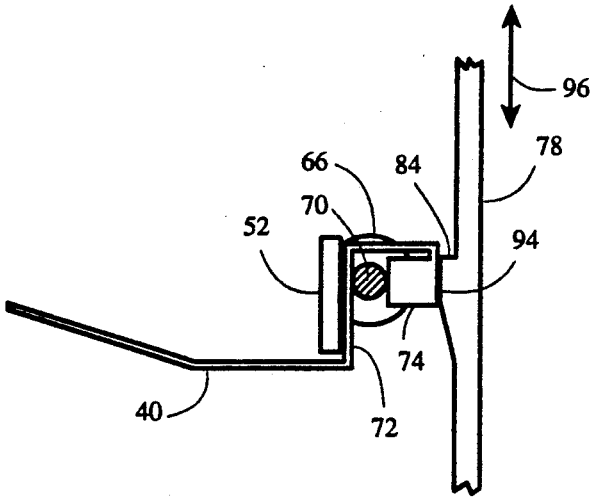
FIG. 5 is top view of the FIG. 4 configuration showing the locking of one of a plurality of a conductors within the junction box by ganged slider means.

The action of the cam means 82–90 of slider 78 is indicated in FIG. 5 by the example of cam means 84, wherein land 94 of cam means 84 is shown as counter-deflecting free leg 74 against the bare end 70 of the conductor 66.

The reciprocation of slider 78 is indicated by arrow 96. The excursion of slider 78 is about one-eighth of an inch. Slider 78 is reciprocated by hand by means of U-shaped tab 97. An indent-detent arrangement (not shown) provides for locking slider 78 in a fixed position to prevent inadvertent disengagement of the cam means from the terminals.

Figure 6:
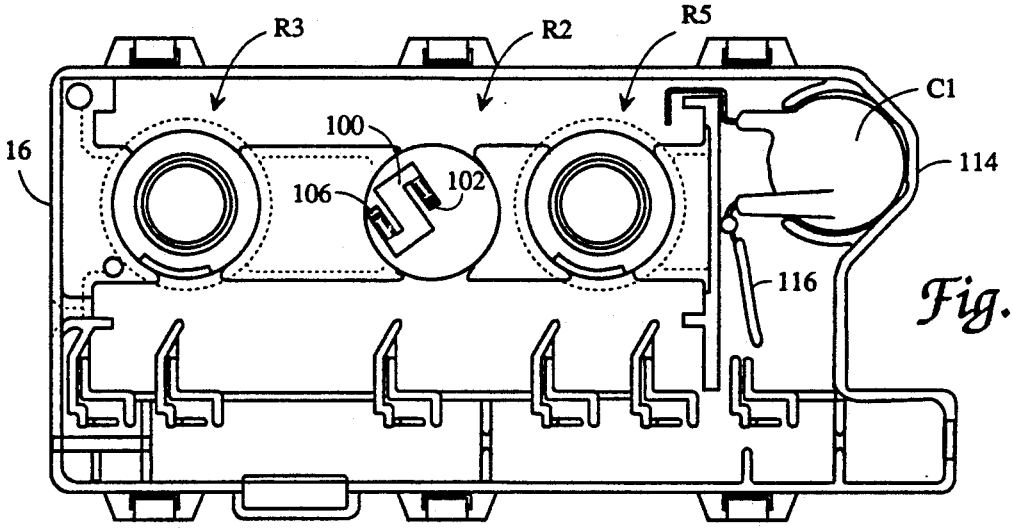
FIG. 6 is a plan view similar to FIG. 2 after removal of printed circuit board and attached terminals.
Figure 7:
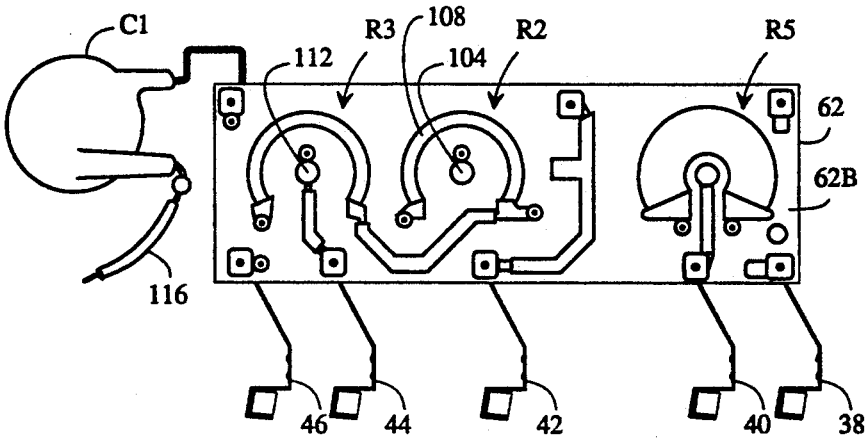
FIG. 7 is a plan view of the opposite side of the printed circuit board shown by FIG. 2.

FIG. 6 is a view in which printed circuit board 62 has been removed from the base section 16 of enclosure 12. The location of means for controlling the static and dynamic focusing of an electron gun are depicted, and indicated as comprising three potentiometers R2, R3 and R5, which are also shown on the schematic diagram of the focusing circuit 99 of FIG. 8. The resistance value of each potentiometer R2, R3 and R5 is controlled by the rotation of a contactor that bridges a center tap and a resistance ring, as indicated by contactor 100 of potentiometer R2. (Note: A similar arrangement is provided, but not shown, in each of the spaces indicated for potentiometers R3 and R5.) The central contact point 102 of contactor 100 rides on the center tap 104 of a potentiometer thick-film-printed on the side 62B of circuit board 62 shown by FIG. 7, with the outer contact point 106 of contactor 100 riding on the peripheral resistance ring 108 of potentiometer R2. The peripheral resistance rings for potentiometers R3 and R5 are also shown by FIG. 7.

Another view of contactor 100 is shown by FIG. 3, in which slider 100 is shown as being mounted on a base 110 which can be rotated manually from outside enclosure 12 by rotation of knob 112A, thus providing for the adjustment of the resistance of potentiometer R2. Knobs 112B and 112C provide for rotation of the contactors of respective potentiometers R3 and R5.

For exemplary purposes, the electrical functions of the junction box according to the invention are described in the following paragraphs in connection with RCA color picture tube A89AET10X03. The tube is designated by the term COTY (combined optimized tube and yoke). The gun is multi-element-focus electron gun with dynamic beam forming. This type of gun has a focus electrode composed of electrically discrete parts for receiving a static voltage for focusing the three beams at the center of the screen and a dynamic voltage for focusing the three beams as they scan the screen.

With appropriate changes in resistance and other values, the junction box according to the invention may as well be used in conjunction with other electron gun types requiring both static and dynamic focus voltages.

Figure 8:
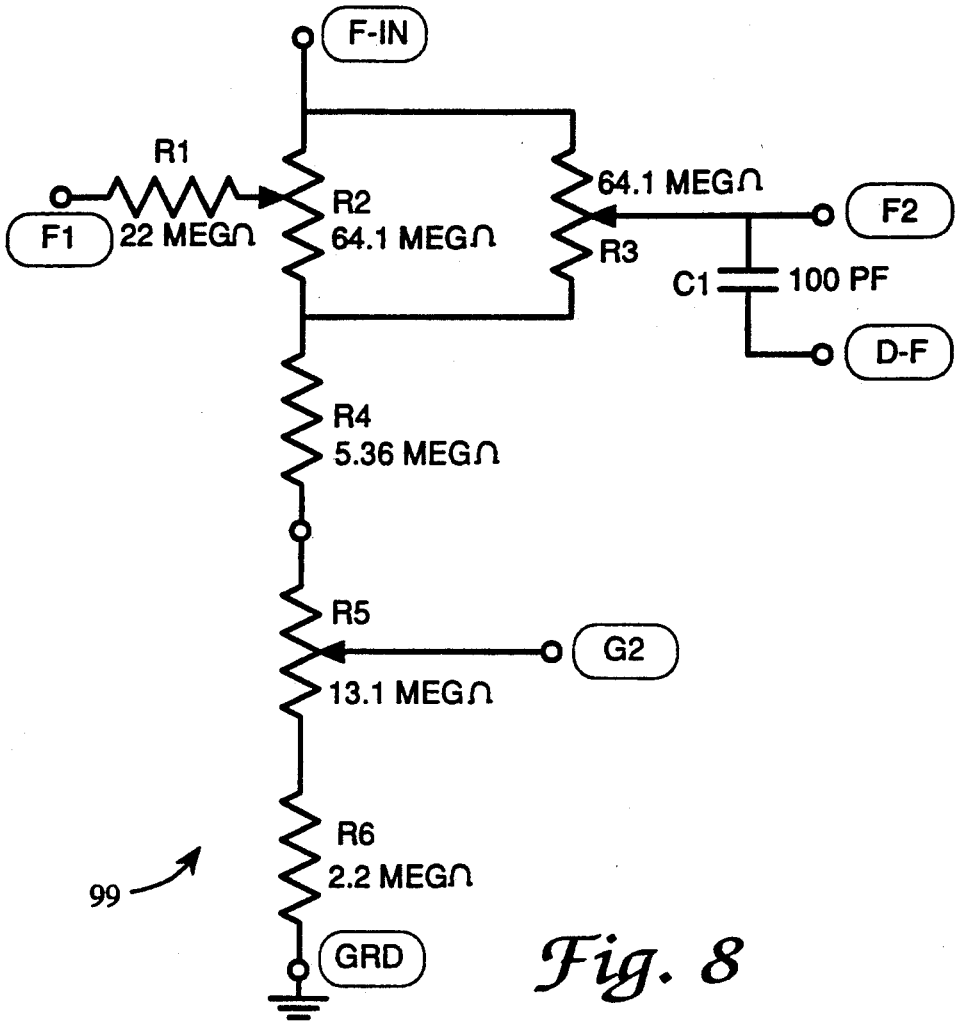
FIG. 8 is a schematic diagram of the electrical circuit of the junction box according to the invention.

The focusing circuit 99 shown by the schematic diagram of FIG. 8 provides for such adjustment of static and dynamic focus of an associated electron gun. Circuit 99 is essentially a divider circuit from which various voltages are introduced and tapped off in the progression from the input F-IN to the ground GRD. As has been noted, the letters circled on the schematic of circuit 99, e.g. F-IN, GRD, et al, are those embossed on cover section 14 adjacent to each of the conductor guide means 24–34, as indicated in FIG. 1 by the associated reference lines. The circled letters are used as references in the description of the operation of circuit 99 that follows.

Circuit 99 receives an input voltage of 10.62 kVdc through F-IN; this voltage can vary depending on the system in which it is used. The ground GRD connection is chassis ground.

Figure 9:
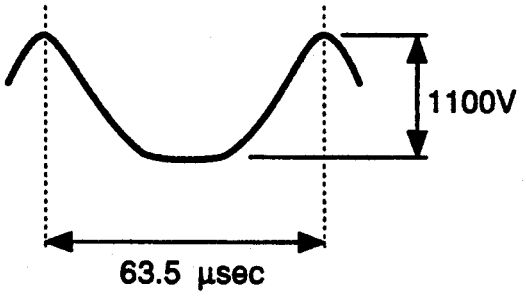
FIG. 9 is a diagram of the waveform that provides for dynamic focusing of an electron gun.

The voltage for dynamic focusing of the beams of the electron gun enters circuit 99 at D-F. As indicated by FIG. 9, the voltage has a peak-to-peak value of 1100 and comprises a parabolic waveform having a frequency equal to the horizontal scan rate of H, or 63.5 microseconds. The focusing voltage is derived from a resonating L-C tank circuit that is shock-excited by a retrace pulse from a high-voltage flyback transformer. A voltage of 5 kVdc is applied to the cathode ray tube through F2, and is connected to the center tap of potentiometer R3; it is modulated by the parabolic voltage applied through coupling capacitor C1. The voltage is applied to the dynamic focusing electrode of the gun through output F2. As indicated in FIGS. 2 and 6, capacitor C1 is enclosed in a separate, walled cavity 114 in base 16, providing for its high-voltage isolation. The high-voltage lead 116 of capacitor C1 is routed from enclosure 12 directly through conductor guide means D-F, as indicated in FIG. 1.

The voltage potentials of 1100 and 5 kVdc noted can vary depending upon the electron gun and cathode ray tube to which they are applied.

The voltage at F1 is dc voltage of approximately the same potential as the voltage at F2; however, it has no ac component or parabolic waveform.

The voltage of output G2, as controlled by potentiometer R5, provides for adjusting the cut-off voltage of the electron gun by its connection to the second control grid of the gun. Potentimeter R2 controls the dc voltage applied to grid F1 of the cathode ray tube.

By way of example, the potentiometers control the following voltage ranges: R2, 6.5 kV to 10 kV; R3, 6.8 kV to 10.3 kV; and R5, 240 V to 1.5 kV.

The material of the enclosure 12 and the contactor 78 comprises Rynite FR 530 manufactured by DuPont, Wilmington, Del. An equivalent material made by another manufacturer can as well be used provided that it can pass the UL recognized (yellow card listed) specification.

The leaf-spring terminals 38–46 are preferably tin-plated spring brass, one-half hard, with a thickness of 0.010 inch.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. A junction box for interconnecting a plurality of sheathed, bare-end, high-voltage conductors for cathode ray tubes and the like, comprising:

housing means including enclosure means;

a plurality of spaced, parallel-arranged leaf-spring terminals mounted within said enclosure means;

a like plurality of conductor guide means for guiding conductors into said enclosure means and into contact with respective terminals;

a like plurality of back support means located respectively adjacent said terminals and said guide means, each of said back support means supporting one side of one of said conductors as it is inserted into said enclosure means through a respective guide means and into engagement with a respective terminal, each of said back support means and associated terminal being constructed and arranged such that as a conductor is inserted into said enclosure means and guided to a terminal by one of said guide means, the terminal is deflected and said conductor is friction-gripped by said terminal such as to modestly resist inadvertent withdrawal of the conductor from the terminal and the enclosure means;

ganged cam means for simultaneously locking a plurality of conductors in said enclosure means against withdrawal, comprising:

a slider mounted for manual reciprocal movement behind said plurality of terminals and orthogonal to the direction of conductor insertion into said enclosure means, said slider mounting a like plurality of cam means which act, when said slider is reciprocated into a locking position, to counter-deflect said terminals against said conductors to greatly amplify the friction forces applied to said conductor and thereby to prevent withdrawal thereof from said enclosure means.

2. The junction box defined by claim 1 including means for locking said slider in said locking position to prevent inadvertent disengagement of said cam means from said terminals.

3. The junction box defined by claim 1 wherein said terminals each comprise an inverted V-shaped leaf spring, one leg of which is anchored, and a free leg of which engages and frictionally grips a conductor.

4. The junction box defined by claim 1 including means for controlling the static and dynamic focusing of said gun.

5. The junction box defined by claim 4 wherein said means for controlling the static and dynamic focusing of said gun comprises potentiometer means.

* * * * *